United States Patent [19]

Miskech et al.

[11] Patent Number: 5,000,496

[45] Date of Patent: Mar. 19, 1991

[54] TAILGATE LATCH

[75] Inventors: Peter Miskech, Troy; George E. Ruck, Jr., Grosse Ile; William J. Coseo, Livonia, all of Mich.

[73] Assignee: Ford Motor Company, Dearborn, Mich.

[21] Appl. No.: 250,048

[22] Filed: Sep. 28, 1988

[51] Int. Cl.[5] ..... E05C 3/26

[52] U.S. Cl. ..... 292/225; 292/DIG. 43; 292/DIG. 55

[58] Field of Search ..... 292/221, 225, 341-18, 292/304, DIG. 14, DIG. 60, DIG. 55, DIG. 43

[56] References Cited

U.S. PATENT DOCUMENTS

| | | | |
|---|---|---|---|
| 2,269,537 | 1/1942 | Krause | 292/1 X |
| 2,492,683 | 12/1949 | Claud-Mantle | 292/11 |
| 2,681,245 | 6/1954 | Ackermans | 292/341.19 |
| 2,715,538 | 8/1955 | Janonis | 292/DIG. 14 X |
| 2,723,552 | 11/1955 | Dlugatch | 292/DIG. 14 X |
| 2,795,450 | 6/1957 | Claud-Mantle | 292/225 X |
| 2,797,947 | 7/1957 | Soroka | 292/11 |
| 2,807,491 | 9/1957 | Deeley-Jones | 292/304 |
| 2,832,620 | 4/1958 | De Orlow | 292/DIG. 43 X |
| 2,832,621 | 4/1958 | De Orlow | 292/DIG. 14 X |
| 2,859,062 | 11/1958 | Hynes | 292/DIG. 14 X |
| 2,886,365 | 5/1959 | Fox et al. | 292/341.18 |

*Primary Examiner*—Richard E. Moore

*Attorney, Agent, or Firm*—Daniel M. Stock; Clifford L. Sadler

[57] ABSTRACT

A latch for the tailgate of a pickup truck is provided which employs a conical striker mechanism engaging a resiliently biased jaw, contact surfaces of the jaw and striker being arranged to cause further locking engagement upon attempted withdrawal of the striker from engagement with the jaw in the locked condition, the striker and jaw being arranged in the vehicle body to be self-adjustingly positionable at assembly and utilize a minimal number of separate parts to perform these functions.

1 Claim, 2 Drawing Sheets

TAILGATE LATCH

BACKGROUND OF THE INVENTION

The present invention relates generally to latches and more specifically to the latches employed to secure pivotally mounted tailgates to adjacent body panels of pickup trucks.

DESCRIPTION OF THE PRIOR ART

A variety of approaches have been taken in providing latches for the tailgates of pickup trucks. The approaches range from simple sliding pins or bolts extending laterally outwardly from the tailgate into upstanding rear pillar areas of the truck's pickup box to relatively complex cylindrical striker-engaging double jaw arrangements similar to latches employed to secure passenger doors. As efforts in the automotive industry continue to reduce vehicle weights and to increase truck pay load and fuel efficiency, the simplification and lightening of truck mechanical components has become increasingly important. The use of plastics and reduced thickness metals in vehicle body areas such as the tailgate and adjacent pickup box creates a latching environment in which use of the simple sliding pin or bolt arrangement can be disadvantageous because of the significant bending loads that may be imposed upon the tailgate and adjacent pickup box. The same loading problems may be true of certain jaw and striker designs, and these, additionally, tend to be relatively complex and uneconomical to produce.

Other types of latches are or have been in use in other automotive vehicle applications. One relatively simple type of latch is illustrated by those which employ a conical striker. U.S. Pat. No. 2,269,537 to Krause, U.S. Pat. No. 2,492,683 to Claude-Mantle, U.S. Pat. No. 2,797,947 to Soroka and U.S. Pat. No. 2,807,491 to Deeley-Jones exemplify such latches used in a hood closure environment of automotive vehicles. All of the known conical striker latches employ a simple annular locking area adjacent a striker's cone for engaging some plate or wire member after passage of a conical portion into a locking position. The hood closure area is a relatively lightly loaded environment and the design of the conical striker latches heretofore has not been suitable for more heavily loaded environments such as encountered in the pickup truck tailgate area. The prior art latches employing conical strikers suffer from a further disadvantage that alignment of the working parts of the striker and keeper at assembly tends to be time consuming and laborious.

SUMMARY OF THE INVENTION

It is accordingly an object of the present invention to provide a latch for releasably securing a closure panel, such as a tailgate, to an automotive body, which is simple and economical to manufacture and assemble and which provides substantial resistance to opening when in a latched or closed position.

It is a more specific object of the present invention to provide such a latch which employs a conical striker and a catch mechanism for engaging the conical striker which provides improved resistance to pull-out of the striker from its engaged position within the catch.

According to a feature of the present invention, a latch is provided which includes a conical striker adjustably positioned in a rear pillar of a pickup truck load box which engages a jaw member carried within a tailgate wherein the jaw member includes an integrally formed actuating lever having means for pivotally mounting a cable for simple economical actuation of the jaw.

According to a further feature of the invention, the jaw member includes surfaces formed on the jaw for engaging the locking surfaces of the striker member so positioned with respect to the pivotal axis of the jaw that movement of the striker member from the closed toward the open position when the jaw is in the latched condition, tends to drive the jaw member further into the latching direction.

BRIEF DESCRIPTION OF THE DRAWINGS

These and other objects and features of the invention will become apparent to those skilled in the automotive body arts upon reading the following description with reference to the accompanying drawings in which.

DESCRIPTION OF THE PREFERRED EMBODIMENT

Figure 1:
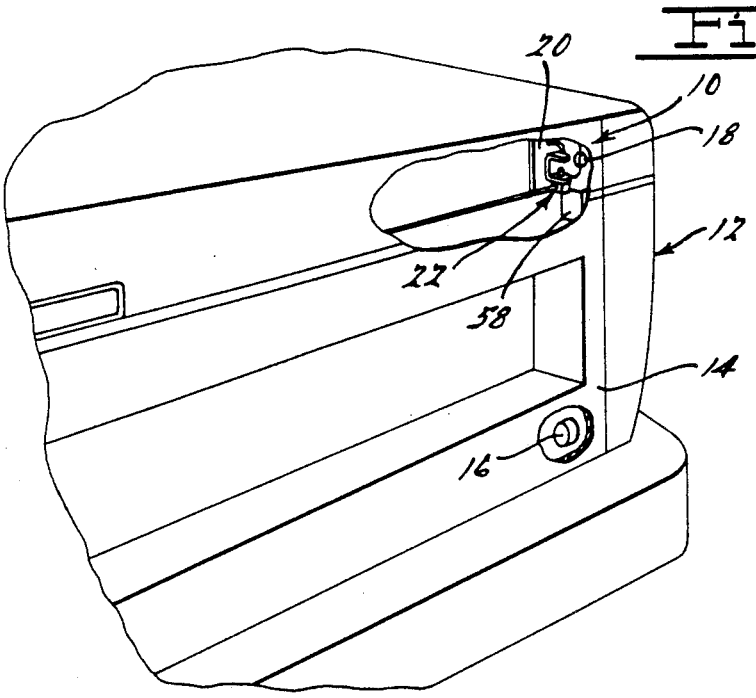
FIG. 1 is a perspective view of a rear portion of a pickup truck illustrating a tailgate and adjacent truck body panels in which the latch of the present invention is installed.

Turning now to the drawings and in particularly to FIG. 1 thereof, a latch assembly 10 according to the present invention is illustrated as being installed in the body 12 of a pickup truck. It will be understood that while only one side of the body 12 is illustrated, another latch assembly 10 will normally be provided symmetrically positioned on the other side of the truck. The body 12 includes a tailgate 14 which is pivotally connected as by a hinge indicated at 16 to portions of the body 14 for closing the conventional opening at the rear end of a pickup truck body 12. The latch 10 consists essentially of a striker member 18 mounted on a fixed portion of the body 14, such as the D-pillar 20 and a catch assembly 22 carried with the tailgate 14.

Figure 2:
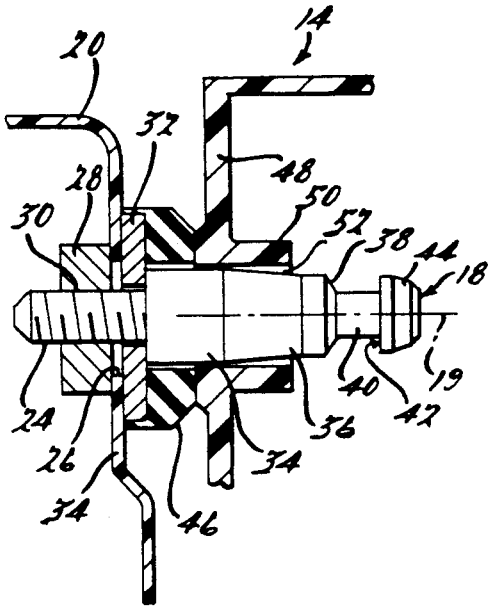
FIG. 2 is a cross-sectional view of the striker of the latch of the present invention illustrating its installation in the pickup box panel and its insertion into the tailgate.
Figure 5:
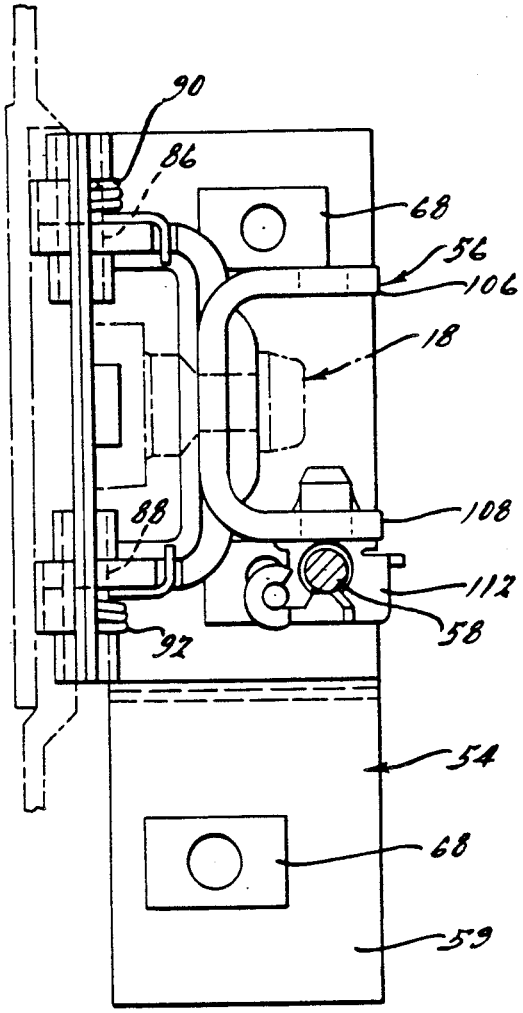
FIG. 5 is a side view of the latch of the present invention with the striker member and the adjacent body panels shown in dotted line for clarity of presentation.

Turning next to FIG. 2 the striker member 18 is illustrated as it is installed on the D-pillar 20, separated from the catch assembly 22 for clarity of graphical presentation. The striker member 18 is illustrated as an elongated stepped member having a threaded attachment end 24 inserted through an aperture 26 of substantially greater cross-section into threaded engagement with a striker mounting plate internally threaded as indicated at 30. A washer 32 abuttingly engages an outer surface 34 of the D-pillar 20. A shank portion 34, preferably of the circular cross-section, extends outwardly from the attachment end 24 and abuts the washer 32 and a conical relief portion 36 extends from the termination of the shank portion 34 to a preferably stepped extension section 38 having a reduced diameter portion 40 terminating in an annular locking shoulder 42. A conical striker face 44 extends outwardly away from the locking shoulder 32.

A resilient striker cushion 46 surrounds the shank portion 34, covering the washer 32, to provide cushioning between the D-pillar 20 and the tailgate 14 when the tailgate 14 is swung pivotally into the closed position shown in FIG. 1. It is contemplated that the tailgate 14 may be formed of any material suitable for the fabrication of automotive body parts, including plastics. For any material choice, however, a tailgate inner panel 48 is provided and in vehicle applications in which substantial loadings that could deflect the panel 48 significantly could occur, it has been found useful to provide an upstanding reinforcement boss 50 about a bore 52 formed through the inner panel 48 for receiving the striker member 18. It will be appreciated as the description progresses that the catch assembly 22 is positioned within the tailgate 14 behind the inner panel 48 in alignment with the bore 52 and thus the striker member 18 to ensure accurate positioning of the striker member 18 when the truck 12 is assembled. The striker 18 is loosely engaged with the striker mounting plate 28 and free to float within the boundaries formed by the aperture 26 through the D-pillar 20. When the tailgate 14 is pivoted to the closed position of FIG. 1, striker member 18 may be readily manipulated to engage the catch assembly 22 and assume the locked position. The striker plate 28 may then be tightened to clampingly secure the striker member 18 to the D-pillar 20 in its proper selected position with respect to the tailgate 14 and the catch assembly 22.

Under severe loading conditions, the longitudinal axis 19 of the striker member 18 may become canted with respect to the nominal position shown in FIG. 2 because of deflections in the D-pillar and/or the inner panel 48 of the tailgate 14. The clearance provided by the conical relief portion 36 of the striker member 18 ensures that clearance is maintained between the outer surfaces of the striker member 18 and the aperture 52 so that withdrawal of the striker member 18 from the closed position can be effected under such loading conditions.

Turning now to FIGS. 3–6, the catch assembly 22 is illustrated as comprising a mounting bracket 54 and a jaw member 56 pivotally mounted on the bracket 54. A cable 58 or other linear actuator is pivotally mounted to the jaw member 56 for moving it with respect to the bracket 54. The bracket 54 is preferably formed from a pair of stamped plates, an inner plate 58 and an outer plate 60. It should be understood, however, that in some vehicle applications portions of a tailgate itself may be formed to duplicate the function of the outer plate 60. In the embodiment illustrated, the inner plate 58 has a leg portion 59 secured to a side portion 62 of the tailgate inner panel 48. An upper portion 64 of the inner panel 58 is formed in L-shaped fashion as may best be seen in FIG. 6 to confront the front wall 66 of the tailgate inner panel 48. The outer plate 60 is also formed as an L-shaped plate surrounding the upper portion 64. Threaded fasteners 68 are carried on the mounting bracket 54 for cooperation with suitable fasteners (not shown) to fix the bracket 54 with respect to the tailgate 14 and a window 61 is formed through the plates 58, 60 for receiving the striker member 18.

Figure 3:
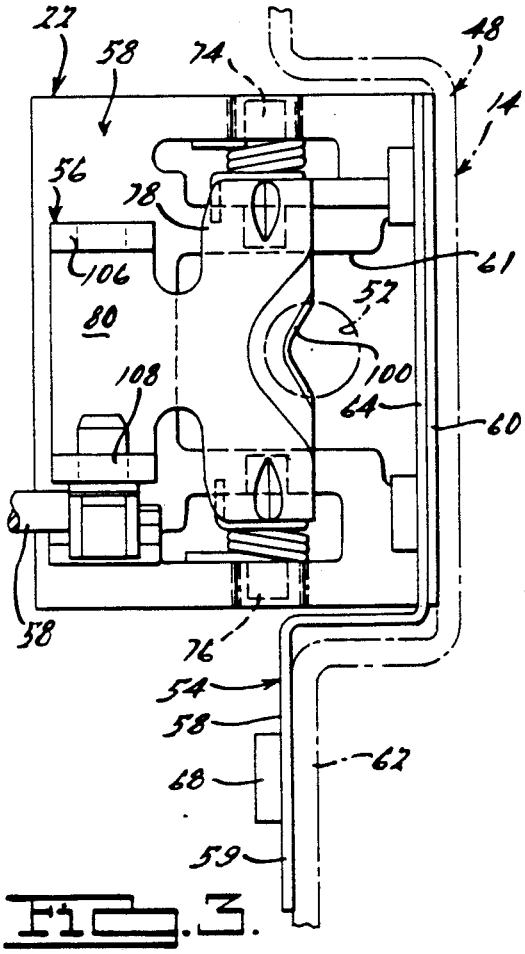
FIG. 3 is a front view of the latch of the present invention illustrating the jaw member in the latched position.
Figure 4:
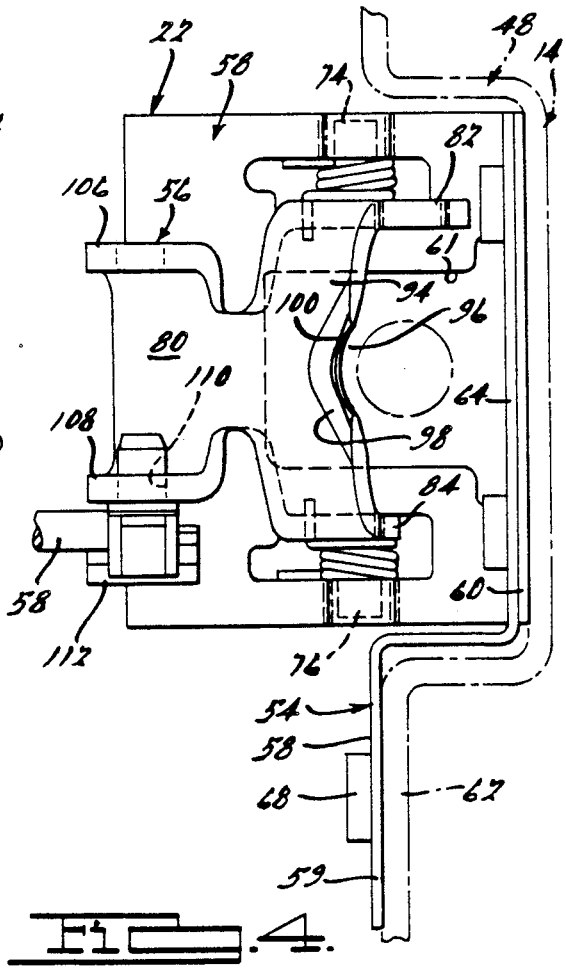
FIG. 4 is a view similar to FIG. 1 showing the jaw in the open position.
Figure 6:
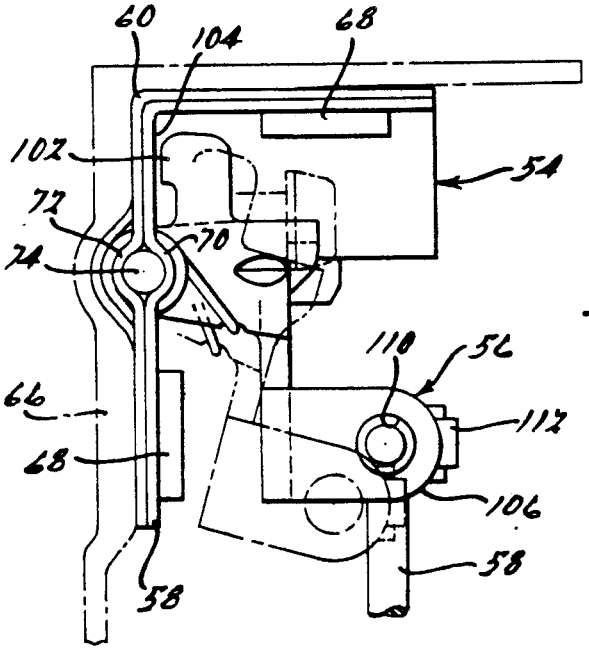
FIG. 6 is a top view of the latch of the present invention showing the jaw member and latch in open positions.

As may best be seen in FIG. 6, the inner plate 58 and the outer plate 60 are locally deformed as indicated at 70, 72 to fixedly secure a pair of pivot pins 74, 76 as seen in FIGS. 3 and 4 for pivotally mounting the jaw member 56.

The jaw member 56 is preferably integrally formed as a stamping, including a locking jaw 78 and a release lever 80. The locking jaw 78 includes a pair of spaced legs 82, 84, each including a through bore 88 for rotatably receiving the pivot pins 74, 76, respectively. Coil springs 90, 92, respectively, are grounded between bracket 54 and the locking jaw 78 urging the jaw member 56 toward positions lockingly engaging the striker 18, as may best be seen in FIG. 6. Those skilled in the art will understand that other spring arrangements for biasing the locking jaw 78 are also possible. Connecting the legs 82, 84 is a central locking portion 94 which includes a ramp-like conically formed centering surface 96 registering with the conical portion 44 of the striker member 18 during closure of the tailgate 14. The rear surface of locking portion 94 is also struck out to form a truncated conical portion having a ring-like locking surface 100 for engaging under the locking shoulder 42 of the striker member 18. This configuration enhances the resistance of the invention latch 10 to inadvertent opening from the position in which the tailgate 14 is closed. Forces tending to withdraw the striker member 18 from engagement with the jaw assembly 22 when the locking jaw 78 is in the position of FIG. 5 will tend to urge the locking jaw 78 more into the closed position counterclockwise, as viewed in FIG. 6. Since the line of action between the contact surface 100 of the jaw member 56 and the locking shoulder 42 of the striker member 18 is displaced from the axis of the pivot pins 74, 76 in a direction resulting in such counterclockwise movement, the movement in this direction is limited by the provision of an integral stop tab 102 formed in the lever portion 80 of jaw member 56. The stop abuts a facing surface 104 of the inner plate 158.

Also formed on the lever portion 58 are a pair of upstanding ears 106, 108, each having a through aperture 110 for pivotally mounting a known fastener 112 for axially adjustably positioning the cable 58. As may be readily seen in FIG. 6, pulling the cable 58 pivots the jaw member 56 against the biasing force of the springs 90, 92 so that the tailgate 14 may pivot about the hinge 16 effectively withdrawing the striker member 18 from the catch assembly 22. Reversing the pivotal movement of the tailgate 14 would bring centering surface 96 of the jaw member 56 into engagement with the first conical striker face 44 of the striker member 18, pivoting the jaw member 56 against the influence of the springs 90, 92 until the jaw member 56 snaps into the locking position with the locking surface 100 lockingly engaged under the locking shoulder 42 of the striker member 18. Slight further movement of the tailgate 14 towards the closed position is resiliently resisted by the cushion 56 arrayed about the striker member 18, and no pivoting movement of the jaw member 56 is effected as the central portion of the locking jaw portion 78 of jaw member 56 slidingly engages along the extension portion 40 of the striker member 18.

Only one embodiment of the invention tailgate latch has been here described. Others may be possible without departing from the scope of the appended claims.

We claim:

1. A latch assembly for releasably securing a pivotally moveable tailgate of a vehicle to a fixed body panel of the vehicle, the tailgate being moveable between open and closed positions, the latch assembly comprising:

an elongated striker member secured to the fixed panel and extending outwardly therefrom and having a mounting bracket at its free end and an annular locking surface formed adjacent the first conical portion;

a catch assembly carried with the tailgate in a position axially alignable with the striker member and having a mounting bracket adapted to be secured to the tailgate and a jaw member carried on the mounting bracket for pivotal movement about an axis between a latched position lockingly engaging the striker member and an open position spaced from the striker member;

means defining a locking surface on the jaw member engageable with the striker member annular locking surface when the jaw member is in the latched position the jaw member locking surface being spaced from the jaw member pivotal axis to create a moment on the jaw member urging the jaw member toward the latched position upon movement of the tailgate toward the open position when the striker member is lockingly engaged by the jaw member;

lever means integrally formed with the jaw member for reducing the force required to effect the jaw member pivotal movement toward the opened position; and cable means pivotally mounted on the lever means to effect movement of the lever means moving the jaw member toward the opened position in response to pulling the cable means.

* * * * *